US007152820B1

(12) United States Patent
Baker et al.

(10) Patent No.: US 7,152,820 B1
(45) Date of Patent: Dec. 26, 2006

(54) ASPHALT RECYCLING DEVICE AND METHOD OF USING

(76) Inventors: John Baker, 21366 Highway 52, St. Olaf, IA (US) 52072; Bill Malinowski, 105 N. Main, Garnavillo, IA (US) 52049

( * ) Notice: Subject to any disclaimer, the term of this patent is extended or adjusted under 35 U.S.C. 154(b) by 0 days.

(21) Appl. No.: 10/904,796

(22) Filed: Nov. 30, 2004

(51) Int. Cl.
*B02C 18/22* (2006.01)

(52) U.S. Cl. ..... 241/65; 241/236; 241/260.1

(58) Field of Classification Search ..... 241/65, 241/236, 191, 222, 260.1, 291
See application file for complete search history.

(56) References Cited

U.S. PATENT DOCUMENTS

| | | | | |
|---|---|---|---|---|
| 2,043,328 | A * | 6/1936 | Mosshart | 241/139 |
| 4,333,612 | A * | 6/1982 | Hayashi | 241/33 |
| 4,711,600 | A | 12/1987 | Yates | |
| 4,946,307 | A | 8/1990 | Jakob | |
| 5,167,372 | A * | 12/1992 | Poggie et al. | 241/23 |
| 5,188,299 | A | 2/1993 | Hendrickson et al. | |
| 5,335,989 | A | 8/1994 | Tanaka | |
| 5,451,003 | A | 9/1995 | Omann | |
| 5,520,342 | A | 5/1996 | Hendrickson et al. | |
| 5,526,991 | A * | 6/1996 | Bacher et al. | 241/65 |
| 5,743,471 | A * | 4/1998 | Ivanov | 241/16 |
| 5,791,814 | A | 8/1998 | Wiley | |
| 5,833,863 | A | 11/1998 | Richards et al. | |
| 6,036,124 | A * | 3/2000 | Takahashi et al. | 241/38 |
| 6,073,866 | A * | 6/2000 | Silver et al. | 241/19 |
| 6,227,620 | B1 | 5/2001 | Page | |
| 6,325,311 | B1 * | 12/2001 | Preisser | 241/74 |
| 6,685,465 | B1 | 2/2004 | Marquart | |

* cited by examiner

*Primary Examiner*—Faye Francis
(74) *Attorney, Agent, or Firm*—Ryan N. Carter

(57) ABSTRACT

An asphalt heating and drying device for recycling or repairing asphalt. Nuggets of waste asphalt are inserted into a heat chamber that has a plurality of heat tubes that carry hot air into the chamber and adjacent to the waste asphalt nuggets. The heat chamber has a "live floor" with controllable spinning rotors which have forward reaching teeth. The spinning rotors pull the asphalt from the heat chamber into a lower chamber having two horizontal spiral augers. The augers mix the asphalt nuggets and the lower chamber heats the asphalt nuggets to their ultimate delivery temperature. The hot dry asphalt is then expelled from the device.

9 Claims, 4 Drawing Sheets

ASPHALT RECYCLING DEVICE AND METHOD OF USING

BACKGROUND OF THE INVENTION

This invention relates to asphalt recycling, and more particularly to an apparatus which heats and dries nuggets of asphalt which have been ripped from a paved surface to convert them into asphalt which can be used in the same manner as newly manufactured asphalt.

Asphalt and Portland Cement (concrete) are the two constituents of hard surfacing for the major roads in America's transportation system. In excess of 90% of America's roads are surfaced with asphalt. Asphalt is typically manufactured in large scale plants by mixing sized aggregate, sand, and asphalt cement (petroleum compound). This mixture is then dispensed into transport vehicles and taken to jobsites. Most current asphalt jobs involve re-paving existing roadways or parking areas, which often requires the old pavement to be transported away from the jobsite after it is ripped from the paved surface.

As an alternative to manufacturing new asphalt in an asphalt plant, chunks or nuggets of discarded asphalt can be recycled and reused as asphalt. The waste asphalt nuggets can be re-introduced into new asphalt mixtures, or they can be reheated and used for patching paved surfaces. If properly prepared, recycled asphalt can be of the same quality as new asphalt, yet it is cheaper to produce. Recycling of asphalt can be done on a large scale in an asphalt plant, or on a smaller scale using recycling machines at the jobsite.

U.S. Pat. Nos. 5,791,814 and 4,946,307 disclose an apparatus for recycling asphalt at a job site. Although on-site recycling devices have limited production compared with large asphalt plants, the on-site application increases time and cost efficiency because the asphalt does not need to be transported to and from the asphalt plant. By using the asphalt recycling machines, contractors can avoid buying new fresh mix from an asphalt plant, trucking costs to get the fresh mix to the site and the old asphalt to a disposal area, and, in some cases, dumping fees.

Output quality and quantity from asphalt recycling machines varies depending on the condition of the asphalt being recycled, its moisture content, and the amount of contamination (non-asphaltic material) contained in the asphalt. To achieve high quality and quantity of recycled asphalt, the reusable nuggets of asphalt must be warm and dry before they are introduced for recycling. The use of warm, dry asphalt increases both the physical strength and the adhesion strength of the recycled product. U.S. Pat. No. 5,335,989 describes an enclosed heated chamber called a "hotbox" which is used to heat and dry asphalt nuggets before they are introduced for recycling. After several hours in a hotbox, the reusable nuggets of pavement are soft, warm, dry, and capable of being manually shoveled into potholes or introduced for recycling. One problem with hotboxes is that they do not allow continuous introduction of waste asphalt, rather, for each batch of asphalt, the chamber must be filled, sealed, heated, and emptied. Another problem with hotboxes is that large nuggets of asphalt must be manually broken before or during application. Another problem with hotboxes is that they have no means for homogenizing or mixing the material while it is in the hotbox. This lack of mixing reduces quality and quantity of recycled product because it produces some asphalt that is too hot, and some asphalt that is too cold. Furthermore, many hotboxes require waste asphalt to be shoveled into and out of the heating chamber, which requires excessive amounts of time and labor.

Some on-site asphalt recycling machines comprise drying chambers that allow the waste asphalt to be dried in the recycling machine before the recycling process begins. However, this drying step is usually the rate determining step for the entire process. Furthermore, the drying chambers in the recycling machines have many of the same problems as the hotboxes discussed above, such as "batch" loading, and the lack of a mixing means.

Therefore, it is an object of the present invention to provide a device which efficiently heats and dries nuggets of asphalt ripped from a paved surface.

It is further an object of the invention to provide a device that allows for continuous loading and unloading of asphalt instead of batch loading.

It is further an object of the invention to provide a device that is capable of on-site applications so that waste asphalt can be recycled and reused at the jobsite.

It is further an object of the invention to provide an efficient device for use in asphalt recycling which will make asphalt recycling cost effective for contractors and thus reduce the amount of waste asphalt sent to landfills.

Other objects of the present invention will be apparent from this specification.

SUMMARY OF THE INVENTION

The present invention evenly heats, dries, breaks apart waste asphalt, and homogenizes ingredients into usable recycled asphalt. After asphalt is torn from an existing road, parking lot, path, or other paved surface, the nuggets of torn-up asphalt are loaded into an opening near the top of the present invention. The top of the present invention comprises a rectangular heat chamber that features a plurality of inverted U-shaped heat tubes that carry hot, dry air into, and adjacent to, the asphalt nuggets. This dries and softens the waste asphalt.

The heat chamber has a "live floor" comprising mechanically driven controllable spinning rotors which have forward reaching teeth. The rotors pull the waste asphalt through the "live floor" using the forward reaching teeth to rip and pull apart large pieces of asphalt. The controllable spinning rotors ensure that the asphalt is pulled from the heat chamber at an appropriate rate.

The spinning rotors pull the asphalt into a lower chamber comprising two horizontal spiral augers. The first auger serves as a collector, mixer, and conveyance system. In the lower chamber the commodity is collected, mixed, and heated. The final auger row finishes the product. Finishing consists of heating the mixture to its ultimate delivery temperature, completing the separation of coagulates, and evening dispersion of aggregate. After the product is expelled from the device, it is then ready to be used interchangeably with newly manufactured asphalt in a typical paving or pavement repair procedure.

A unique feature of this invention is its ability to provide a continuous flow of asphalt treatment. Due to the buffering of commodity and the ability to meter hot mix ingredients, the present invention does not require batch loading to achieve product completion as do hotbox-style machines. Pieces of waste asphalt can continuously be loaded into the top, and finished product continuously expelled from bottom the machine.

The present invention is adapted for transport to jobsites, where damaged pavement can be processed and re-applied, typically without additives, resulting in finished pavement equal in quality to newly manufactured asphalt.

DESCRIPTION OF THE PREFERRED EMBODIMENT OF THE INVENTION

Figure 1:
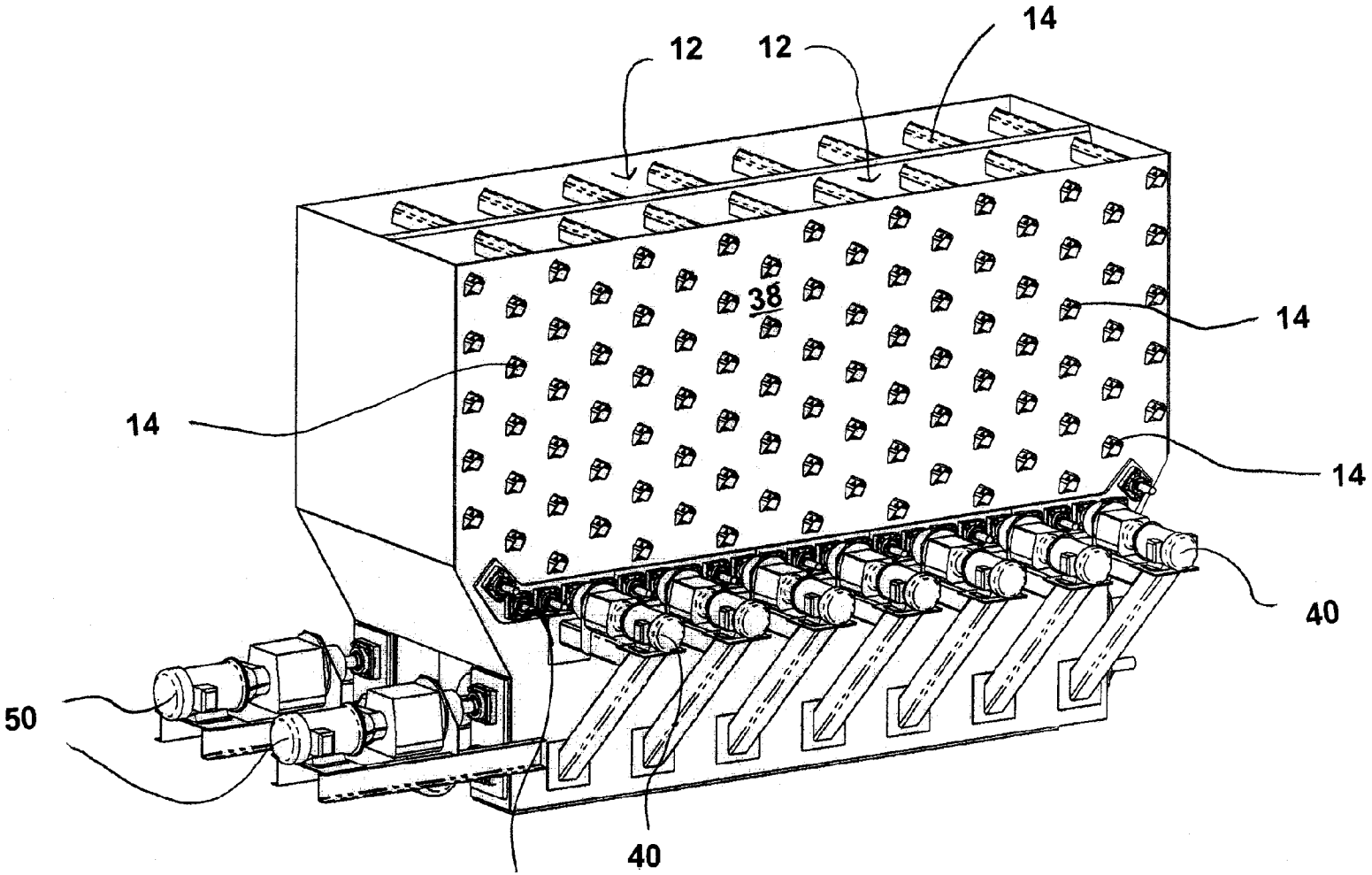
FIG. 1 is a perspective view of the present invention.
Figure 2:
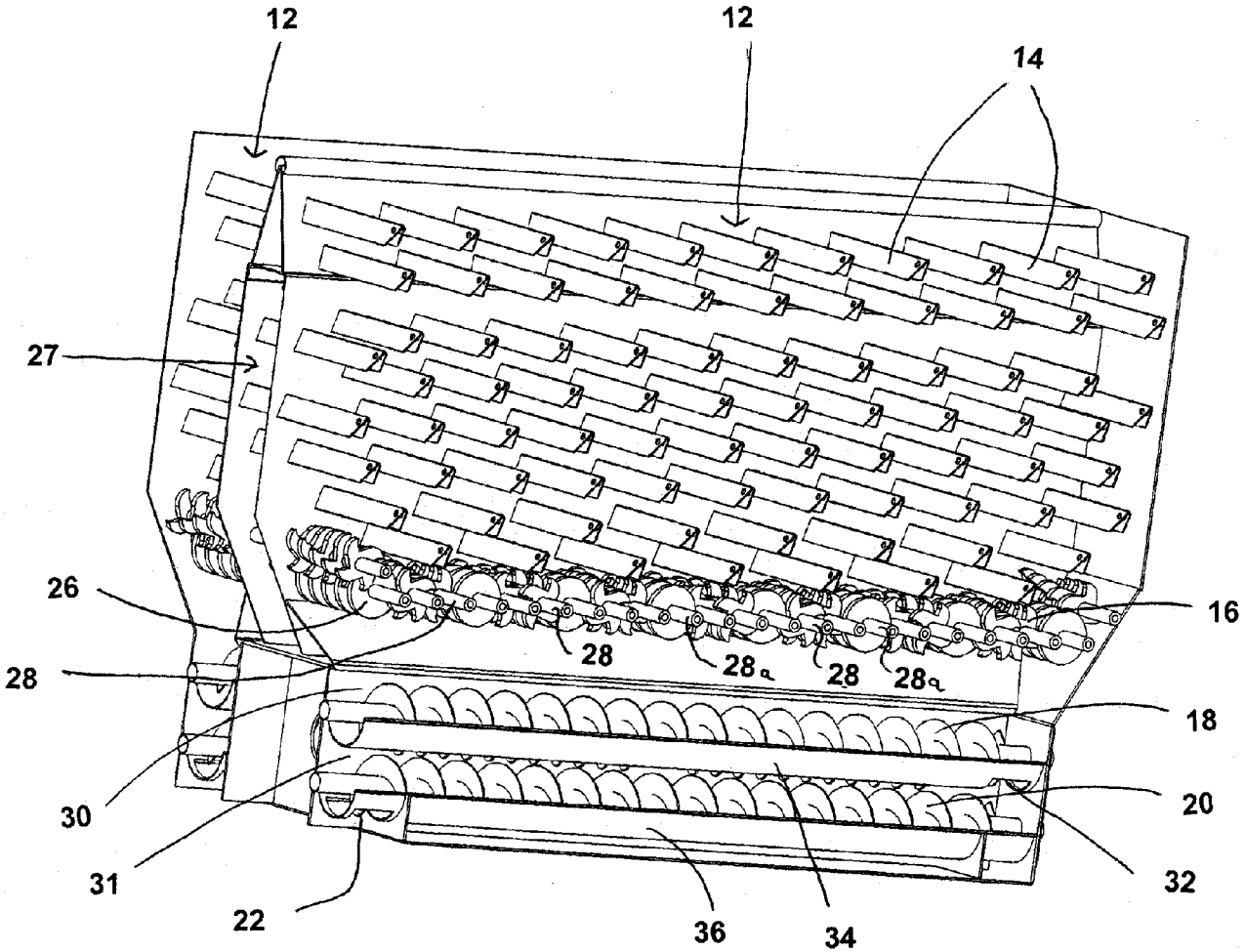
FIG. 2 is a perspective view of the side of the present invention with the outer walls removed to show inner components.

FIG. 1 shows the present invention which serves as an asphalt recycling or repair apparatus. As shown in FIG. 2, the device of the present invention comprises a heat chamber 12 with a large opening near the upper end. After the asphalt is torn or ripped from an existing paved surface such as a road or parking lot, suitably sized nuggets (approximately 1" nuggets) of the waste asphalt (hereinafter "commodity") are inserted into the opening near the top of the heat chamber 12.

Figure 4:
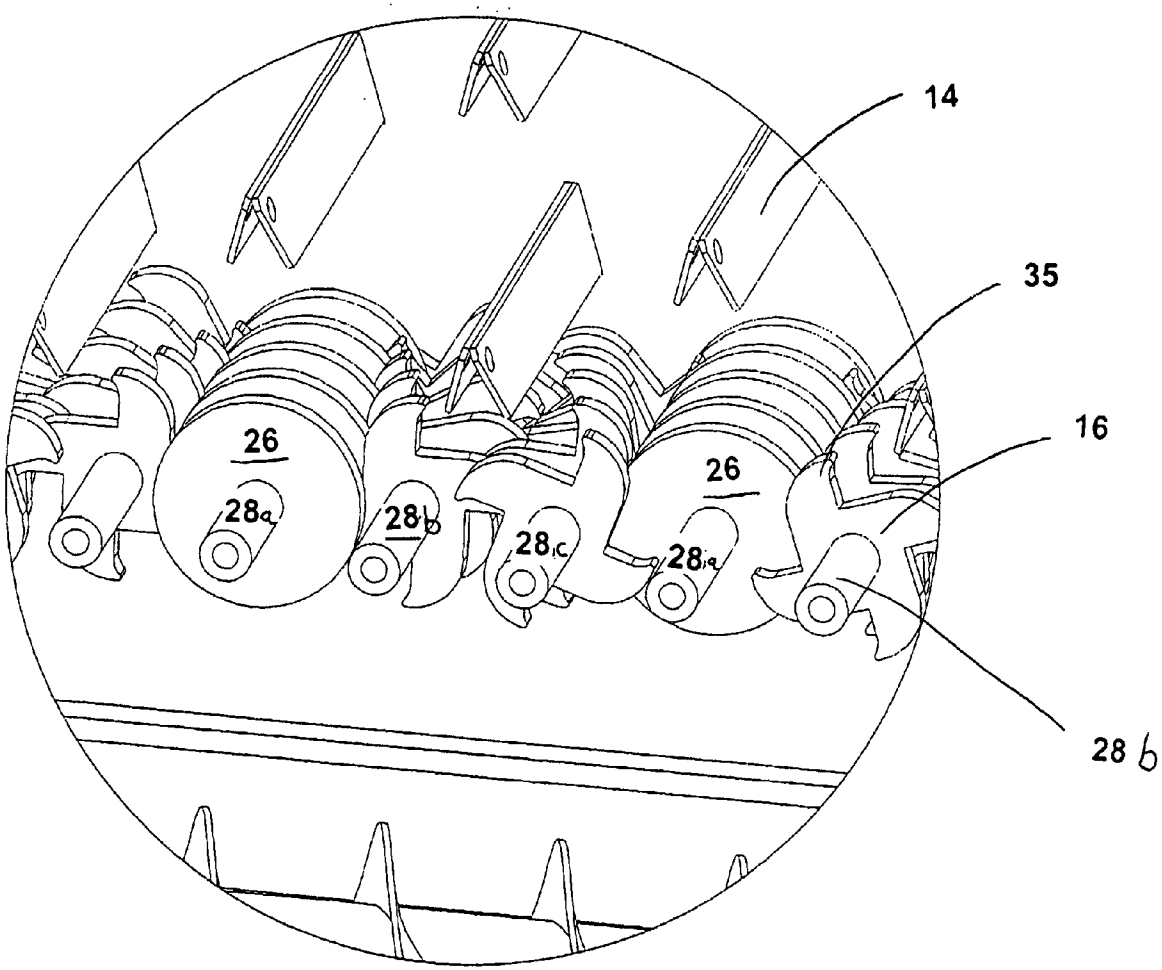
FIG. 4 is a perspective view showing the rotors comprising the live floor of the heat chamber.

The heat chamber 12 comprises a plurality of heat tubes 14 which are generally shaped like an inverted "U" or "V". The heat tubes 14 are best seen in FIGS. 2 and 4. The tubes 14 are not fully enclosed cylinders; rather they have an opening along the length of their bottom side to allow the passage of hot air. In an alternate embodiment, the heat tubes 14 may have a plurality of holes in them which allows the expulsion of hot air. Hot air is transmitted out of the heat tubes 14 and through the commodity to heat and dry the commodity. In the preferred embodiment, the invention heats the commodity to a temperature of approximately 300–400 degrees Fahrenheit, with 350 degrees Fahrenheit being preferred. This movement of hot air out of the heat tubes 14 and adjacent to the commodity is a key aspect of the invention that does not occur in the enclosed chambers of the prior art hotbox-type devices. The air movement ensures even heating. As seen in FIG. 1, portions of the heat tubes 14 extend outside of the side walls 38 of the heat chamber 12, which allows residual moisture to be carried away instead of remaining in the heat chamber 12. To further ensure mixing and even heating of the commodity, the commodity is downwardly migrated around the plurality of heat tubes 14 toward the floor of the heat chamber 12, as described below.

Figure 3:
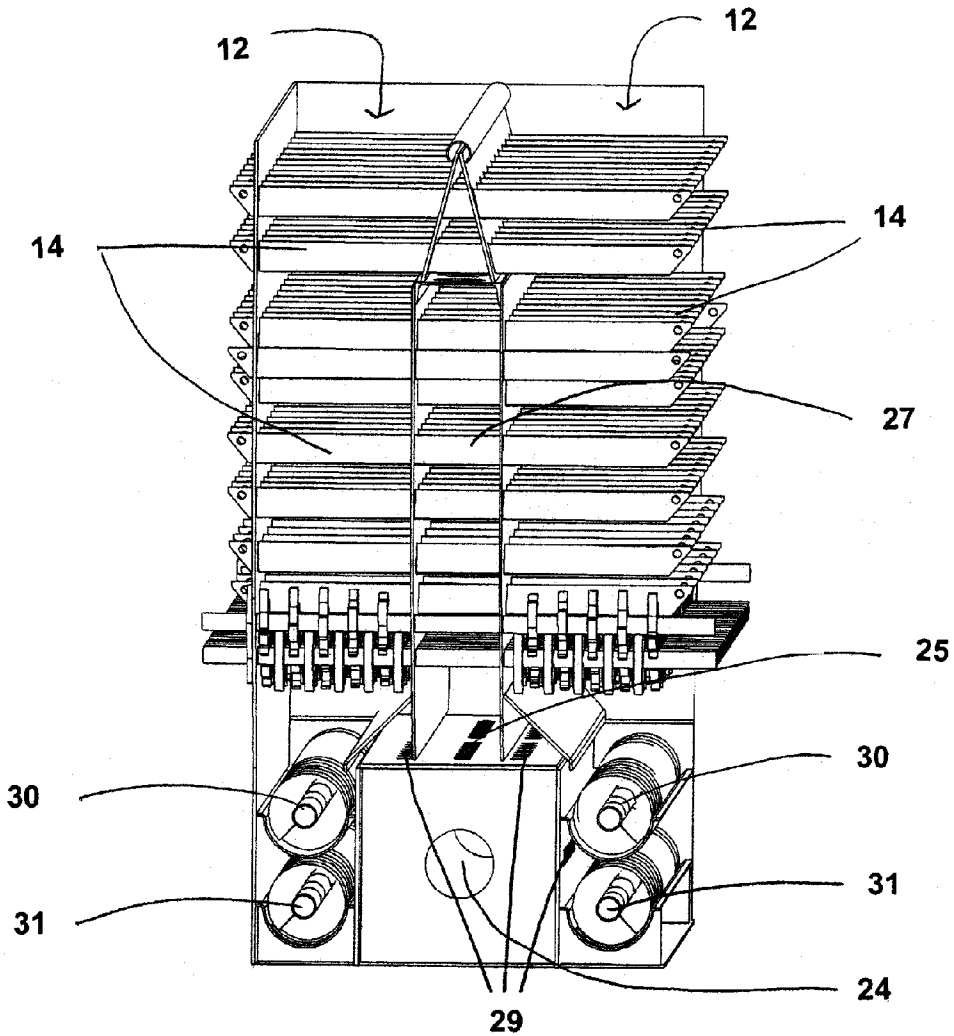
FIG. 3 is a perspective view of the end of the present invention with the outer walls removed to show inner components.

The heat is provided by a heat generator, which in the preferred embodiment is an open flame housed in the flame isolation chamber 24 as shown in FIG. 3. Hot air is carried out of the flame isolation chamber 24 through the heat ducts 25, 29 by fan generated pressure as well as secondary convection. A central heat duct 25, shown in FIG. 3, forces heat into a central heat dispensing chamber 27, and then out into the heat chambers 12 located on either side of the central heat dispensing chamber 27 through the heat tubes 14. Other heat ducts 29 dispense heat into the upper auger chamber 30 and the lower auger chamber 31, respectively. Heat may be dispensed through different heat ducts 25, 29 at different rates to produce different temperatures in different areas of the apparatus. A unique feature of the heating process is that it does not allow the burner flame to come into direct contact with the material being heated. This greatly reduces the potential of overheating the commodity which can cause it to ignite. It also facilitates the re-melting of the asphalt without driving off the more volatile light hydrocarbons in the asphalt thereby producing an undesirably dry product.

As shown in FIGS. 2 and 4, the floor of the heat chamber 12 comprises a plurality of horizontal shafts 28. These shafts 28 extend on either side of the central heat dispensing chamber 27. Some of the shafts 28 are mechanically driven by a power source 40 as seen in FIG. 1. The mechanically driven shafts 28 comprise a plurality of rotors 16 with forward reaching teeth 35 so that each rotor 16 is generally in the shape of a star. In the preferred embodiment shown in FIG. 4, each star-shaped rotor 16 is offset slightly from the rotor 16 next to it on the shaft 28. This offset allows the workload to be divided as evenly as possible among the shafts 28. Some of the shafts are not mechanically driven. The non-driven shafts 28*a* comprise a plurality of non-driven drone wheels 26 which aid in the mixing and breaking of the commodity as described below.

In the preferred embodiment shown in FIG. 4, adjacent horizontal shafts 28 comprise different attachments so that in a series of adjacent horizontal shafts 28, a first shaft 28*a* comprises a plurality of drone wheels 26, a second shaft 28*b* comprises a plurality of rotors 16 which rotate in a first direction, and a third shaft 28*c* comprises a plurality of rotors 16 which rotate in a second direction. This shaft 28 attachment pattern continues along the length of the floor of the present invention. The adjacent rotors 16 rotate in opposite directions so that the first rotor 16 mechanically rotates toward the second rotor, and the second rotor 16 mechanically rotates toward the first rotor 16. The teeth of each respective rotor 16 are reaching in their respective direction of rotation.

The design of the chamber floor holds the commodity in the heat chamber 12 of the machine for heating, until the rotors 16 are mechanically rotated. These mechanically driven rotors 16 function to pull the asphalt through the gap between them and into the upper auger chamber 30 below.

When the rotors 16 are rotated, their teeth 35 will pull the commodity apart (if clumped) and gently sprinkle the aggregate/asphalt cement mixture down into the auger chamber 30 of the machine. This breaking of the commodity into smaller pieces increases the exposed surface area which facilitates more thorough and even heating. Additionally, this separation facilitates moisture removal. The mechanically driven horizontal shafts 28 should be variable speed, reversible, and capable of rotating from two to sixty revolutions per minuets (RPM). The same speeds should be achievable in the reverse direction. The purpose of reversing the rotors 16 is to reject foreign objects that may be impassible or become lodged in-between the rotors 16.

In the preferred embodiment, the reversing cycle occurs automatically when the machine recognizes there may be a jam in one of the rotors 16. When a jam occurs, the rotors 16 at the jam location should reverse, complete approximately ten rotations, and then return to their functional direction of rotation. This may reorient the obstruction so that it can pass, or, if the obstruction is too large to pass, the machine should shut down and alarm after five consecutive reversion cycles. This will give the operator an opportunity to determine and execute a corrective action.

In the preferred embodiment, all of the mechanically driven rotor 16 shafts are controlled independently so that commodity migration velocities into the auger chamber 30 can be controlled. An alternative embodiment employs automatic rotor 16 RPM adjustments to ensure even densities of product as it is sprinkled into the auger chamber 30.

This should also ensure even depletion of commodity nuggets from the heat chamber 12.

A pair of augers 18, 20 are located on either side of the central heat dispensing chamber 27 below the horizontal shafts 28. The augers 18, 20 are driven by a power source 50 as seen in FIG. 1. When the commodity falls into the upper auger chamber 30, it will sprinkle into the upper auger chute 34, which is semi-circular in the preferred embodiment. It will fall between the flutes of the upper auger 18 where it will be driven by the upper auger 18 to the upper auger chute hole 32 located at one end of the upper auger chute 34. The upper auger 18 serves as a collector, mixer, and conveyance system.

The commodity will drop from the upper auger chute hole 32 into the lower auger 20. The lower auger 20 "finishes" the commodity. Finishing consists of mixing and heating the commodity to its ultimate delivery temperature and completing the separation of coagulates and evening dispersion of aggregate. The product will be conveyed and mixed as it moves to the finished product exit hole 22. The finished product exit hole 22 is a hole in the lower auger chute 36. Finished commodity product is expelled from the device through the finished product exit hole 22.

The present invention can be used either alone as an asphalt recycling device wherein it expels finished product ready to be applied to a roadway or parking lot, or it can be used as a pre-cycling device wherein after finished commodity is expelled through the exit hole 22, the finished commodity is then directed into a separate asphalt recycling machine to undergo further recycling treatment.

The present invention is adapted for transport to jobsites. At the jobsite, the old pavement can be removed, processed, and re-applied, typically without additives, resulting in finished pavement equal in quality to newly manufactured asphalt.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A recycling apparatus for the treatment of a recyclable commodity such as asphalt, said apparatus comprising:

a chamber having an entrance opening adapted to receive the commodity, the chamber also having a top end, a bottom end, and side walls;

a heat generator adapted for the production of heat, wherein the heat produced by the generator is in communication with the chamber;

a plurality of rotors combined with the bottom end of the chamber, wherein said rotors are adapted to allow the passage of at least a portion of the commodity from the chamber;

an exit opening providing for the expulsion of the commodity from the apparatus; and a plurality of heat tubes which aid in the communication of heat from the heat generator into the chamber.

2. The recycling apparatus of claim 1 wherein the heat tubes are shaped like an inverted "U" providing an open lower side extending along the length of the tube.

3. The recycling apparatus of claim 1 wherein the heat tubes are positioned horizontally through the chamber.

4. The recycling apparatus of claim 3 wherein at least a portion of the heat tubes extend beyond the side walls of the chamber to allow residual moisture to be expelled from the chamber.

5. The recycling apparatus of claim 1 wherein the heat generator indirectly communicates with the chamber through vents, secondary chambers, and tubes.

6. The recycling apparatus of claim 1 wherein the heat tubes comprise a plurality of openings to aid in the expulsion of hot air out of the tubes.

7. The recycling apparatus of claim 1 wherein the heat tubes aid in the communication of hot air from the heat generator into the chamber.

8. A recycling apparatus for the treatment of a commodity such as asphalt, said apparatus comprising:

a chamber having a top end, a bottom end, and side walls, wherein the chamber has an entrance opening near the top end adapted to receive the commodity;

a heat generator adapted for the production of heat, wherein the heat produced by the generator is in communication with the chamber, and wherein the heat is communicated into the chamber through a plurality of tubes;

a plurality of shafts extending horizontally across the bottom end of the chamber, wherein the shafts are combined with a plurality of rotors having forward reaching teeth, and wherein at least some of the rotors are mechanically driven by a power source so as to be adapted to allow the passage of at least a portion of the commodity between adjacent rotors;

an auger chamber positioned below the plurality of shafts, wherein the heat generator communicates heat into the auger chamber;

at least one auger housed in the auger chamber, said auger adapted for receiving the commodity passed through the rotors; and an exit opening from which finished commodity product is expelled from the apparatus.

9. The apparatus of claim 8 wherein the heat generator is a flame.

* * * * *